US005221022A

United States Patent [19]

Frey, Jr. et al.

[11] Patent Number: 5,221,022

[45] Date of Patent: Jun. 22, 1993

[54] LIQUID STORAGE VESSEL

[75] Inventors: Charles A. Frey, Jr., Lancaster; Charles Aument, Jr., Manheim, both of Pa.

[73] Assignee: Bigbee Steel and Tank Co., Manheim, Pa.

[21] Appl. No.: 702,942

[22] Filed: May 20, 1991

[51] Int. Cl.[5] ..... B65D 17/34

[52] U.S. Cl. ..... 220/612; 220/4.12

[58] Field of Search ..... 220/4.12, 610, 612, 220/623

[56] References Cited

U.S. PATENT DOCUMENTS

| | | | |
|---|---|---|---|
| 299,710 | 6/1884 | Wolff | 220/612 |
| 1,223,777 | 4/1917 | Eby . | |
| 1,681,955 | 8/1928 | Scaife . | |
| 2,039,255 | 4/1936 | Marland | 220/612 |
| 2,325,497 | 7/1943 | Floyd | 220/612 |
| 2,613,015 | 10/1952 | Keating | 220/64 |
| 2,685,857 | 9/1954 | Kuhn | 220/612 |
| 2,741,402 | 4/1956 | Sayre | 220/612 |
| 3,288,342 | 11/1966 | Tinker | 220/612 |
| 3,952,904 | 4/1976 | Verlinden | 220/612 |
| 4,216,874 | 8/1980 | Torisu | 220/5 |
| 4,350,261 | 9/1982 | Roth | 220/612 |

*Primary Examiner*—Joseph Man-Fu Moy

*Attorney, Agent, or Firm*—Buchanan Ingersoll; Alvin E. Ring

[57] ABSTRACT

A vessel for liquid storage comprising a shell and an end element enclosing each end of the shell. The end elements have a central region which is generally planar but which can be provided with indentations for strengthening purposes. The end elements have a peripheral flange comprising a continuous U-shaped channel. The end elements are mounted on the shell so that the outer arm of the U-shaped channel abuts the interior wall of the shell and so that the concave surface of the U-shaped channel faces the interior of the shell so that the outer arm forms a lap joint with the shell. A fillet weld secures the lap joint.

7 Claims, 2 Drawing Sheets

LIQUID STORAGE VESSEL

BACKGROUND OF THE INVENTION

This invention relates to a vessel or tank for liquid storage, and particularly to a vessel of the type commonly used for basement storage of heating oil.

SUMMARY OF THE INVENTION

The shell of the liquid storage vessel of this invention can be of any convenient shape. For example, it can be at least partially round, such as obround or cylindrical, or it can be square or rectangular. Whatever the shape of the shell, the vessel is fabricated by enclosing the ends of the shell with end elements that are preferably generally flat or planar but which can be provided with one or more rib like indentations for strengthening purposes. It is a feature of the invention that the end elements have a peripheral flange comprising a continuous channel, such as a U-shaped channel. The end elements are mounted on the shell so that the outer arm of the U channel abuts the interior wall of the shell while the concave surface of the U channel faces the interior of the shell so that the U channel forms a lap joint with the shell. A fillet weld can secure the lap joint and make it fluid tight.

In the assembled vessel of this invention, the convex surface of the channel provides a continuous peripheral protrusion extending outwardly from the planar surface of the end elements. This protrusion provides a convenient handle enabling a jig to grasp the end plate during mounting of the end element onto the tank shell and for manual handling of the tank after assembly for transport purposes.

BRIEF DESCRIPTION OF THE DRAWINGS

This invention will be more particularly understood by reference to the attached drawings wherein.

DESCRIPTION OF THE PREFERRED EMBODIMENTS

Figure 1:
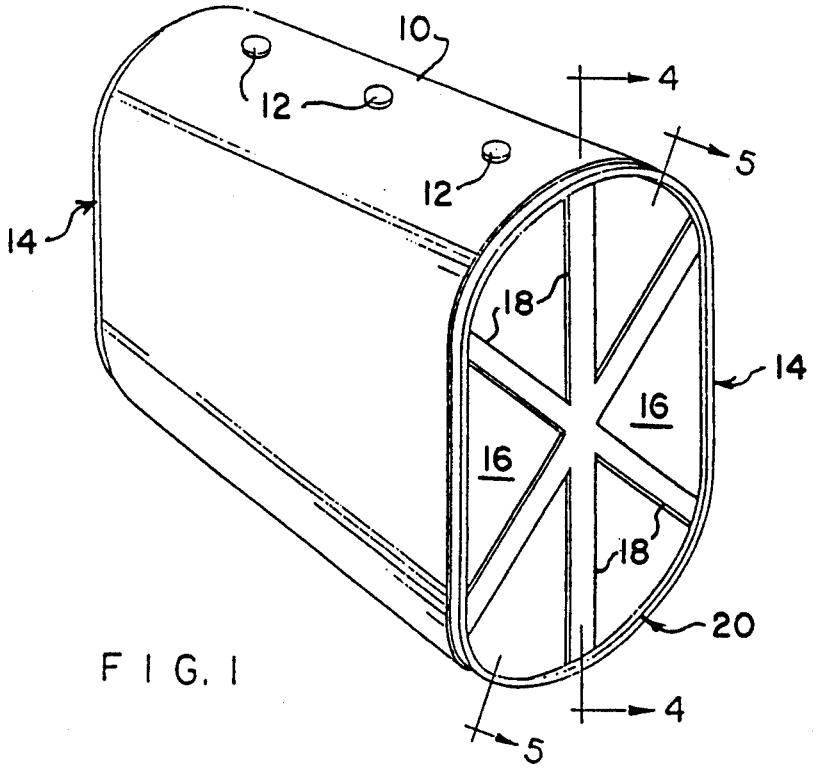
FIG. 1 is an isometric view of an assembled obround tank of the invention.
Figure 2:
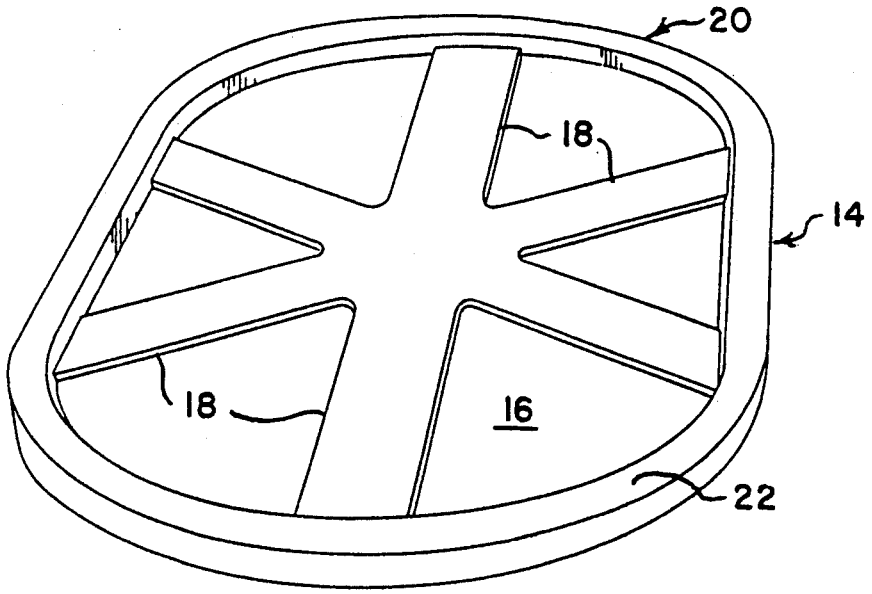
FIG. 2 is an isometric view of an end element of the tank of FIG. 1.

Referring to the figures, obround tank shell 10 having openings 12 for filling, vent and gauge purposes, and legs, not shown, has opposite ends which are enclosed by a pair of end enclosure elements 14. End elements 14 have a generally planar central region 16 whose surface can be interrupted by randomly distributed rib-like protrusions 18. Protrusions 18 comprise indentations or impressions in the metal surface 16 which are seen as protrusions on the outside of the shell and as indentations on the inside of the shell.

Figure 4:
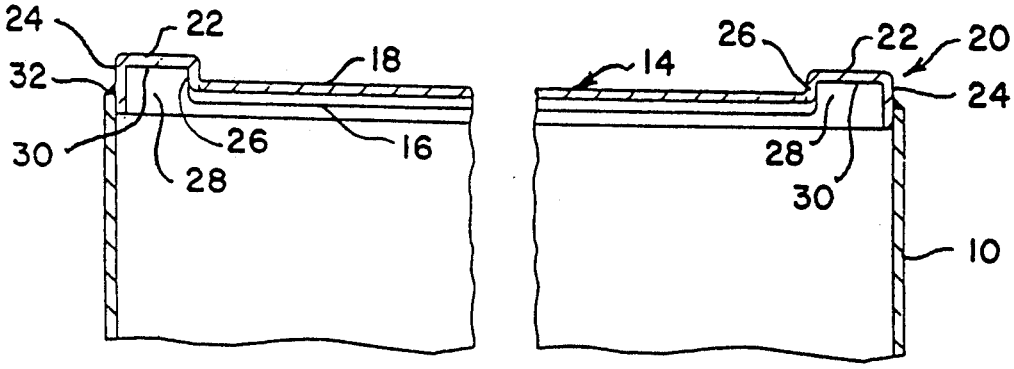
FIG. 4 is a fragment of a cross-sectional view taken through the section 4—4 of FIG. 1.
Figure 5:
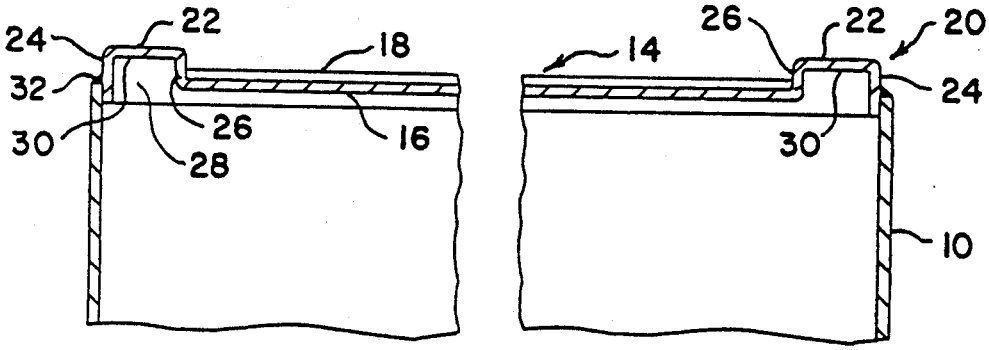
FIG. 5 is a fragment of a cross-sectional view taken through the section 5—5 of FIG. 1.

End closure elements 14 are provided with a peripheral flange 20 which comprises a continuous U-shaped channel. The U-shaped channel comprises a base 22, an outer arm 24, an inner arm 26 and a channel space 28 whose concave base 30 faces the interior of shell 10. As shown in FIGS. 4 and 5, outer arm 24 and inner arm 26 are straight in cross-section.

Each end closure element 14 is mounted on an open end of shell 10 by inserting outer arm 24 of flange 20 interiorly of the wall of shell 10 so that outer arm 24 abuts firmly against the inside wall surface of shell 10 to form a lap joint between outer arm 24 and shell 10 which is sealed along its entire extent by means of fillet weld 32. As shown in FIGS. 4 and 5, the fillet weld 32 joins the terminus of shell 10 to the adjacent surface of outer arm 24 of flange 20.

Figure 3:
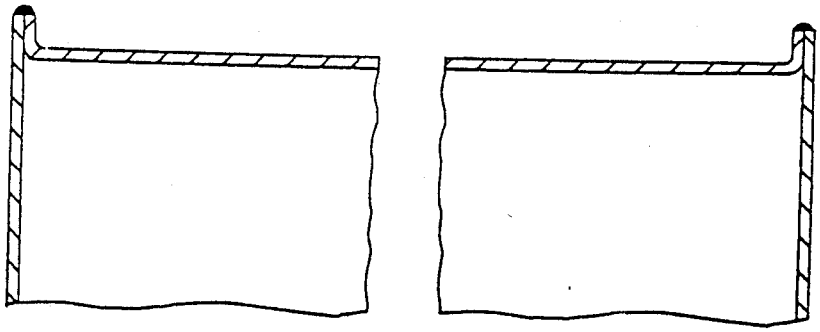
FIG. 3 (PRIOR ART)
FIG. 3 is a fragment of a cross-sectional view of a tank of the prior art.

The lap joint and fillet weld mode of end closure attachment to the shell of this invention provides a continuous peripheral protrusion on the convex surface of the channel extending outwardly from the assembled tank. This protrusion provides a convenient handle for enabling a jig to grasp end plate 14 during assembly of the end plate to shell 10 and again provides a convenient handle for manual handling of the assembled tank. This protrusion and fillet weld arrangement provides a sturdy joint which is protected during normal handling. This arrangement is contrasted with the edge joint and edge weld arrangement of the prior art which is shown in FIG. 3 which provides an exposed end joint weld which cannot be adequately protected during transportation

We claim:

1. A vessel for liquid storage comprising a shell having a shell terminus at each end, an end element enclosing each end of said shell, said end elements having a peripheral flange, said flange comprising a continuous U-shaped channel having straight walls in cross-section, said end elements mounted on said shell so the outer wall of said channel abuts the interior wall of said shell and the concave surface of said channel faces the interior of said shell, the shell terminus at each end of the shell being adjacent to the surface of the outer wall of its respective channel, and the shell terminus at each end of said shell being joined to the surface of the outer wall of its respective channel by a fillet weld.

2. The vessel of claim 1 wherein the central region of said end elements is generally planar and is provided with one or more rib-like indentations.

3. The vessel of claim 1 wherein said shell is at least partially circular in cross section.

4. The vessel of claim 1 wherein said shell is obround.

5. The vessel of claim 1 wherein the central region of said end elements is generally planar.

6. The vessel of claim 1 which is a vessel for the storage of heating oil.

7. The vessel of claim 1 including an opening or openings in said shell for filling, venting or gauge purposes.

* * * * *